United States Patent [19]

Moeser

[11] 4,149,691

[45] Apr. 17, 1979

[54] MOTOR-MOUNTING ASSEMBLY

[75] Inventor: Denis S. Moeser, Clayton, Mo.

[73] Assignee: Leisure Products, Inc., St. Louis, Mo.

[21] Appl. No.: 899,825

[22] Filed: Apr. 25, 1978

[51] Int. Cl.[2] ..... B63B 17/00; B63H 21/26

[52] U.S. Cl. ..... 248/642; 115/17

[58] Field of Search ..... 248/4, 298; 115/17, 115/18 R, 18 E

[56] References Cited

U.S. PATENT DOCUMENTS

| | | | |
|---|---|---|---|
| 2,858,690 | 11/1958 | Sanderson et al. | 248/4 X |
| 3,039,723 | 6/1962 | Seyffer | 248/4 |
| 3,750,988 | 8/1973 | Lyon | 115/17 |
| 3,865,335 | 2/1975 | Roller | 115/17 |
| 3,948,204 | 4/1976 | Brock et al. | 115/18 E |
| 4,033,530 | 7/1977 | Harris | 248/4 |
| 4,094,482 | 6/1978 | Weaver | 115/17 |

FOREIGN PATENT DOCUMENTS

| | | | |
|---|---|---|---|
| 72422 | 9/1916 | Austria | 115/17 |

*Primary Examiner*—J. Franklin Foss

*Attorney, Agent, or Firm*—Koenig, Senniger, Powers and Leavitt

[57] ABSTRACT

An assembly for mounting an outboard motor on a boat, such as at the stern thereof. The assembly comprises an arm extending aft from the stern and having a block at its aft end for mounting the outboard motor at the stern, a guide for axially guiding the arm fore and aft of the boat, and a base on which the guide is removably mounted. The base may be mounted on the boat anywhere within a specified distance inboard of the stern, with the arm being adjustable fore and aft in the guide for mounting the motor at a predetermined position aft of the stern when the base is mounted at different distances (within the aforesaid specified distance) inboard of the stern.

14 Claims, 5 Drawing Figures

MOTOR-MOUNTING ASSEMBLY

BACKGROUND OF THE INVENTION

This invention relates generally to motor mounts for boats and more particularly to an assembly for mounting an outboard motor (such as an electric trolling motor or small gasoline auxiliary motor) on a boat.

Reference may be made to U.S. Pat. No. 3,750,988 for motor mounts generally in the field of this invention.

SUMMARY OF THE INVENTION

Among the several objects of this invention may be noted the provision of an improved assembly for mounting an outboard motor on a boat; the provision of such an assembly which may be mounted on the boat anywhere within a specified distance inboard of the boat and then adjusted for mounting the motor in a predetermined position outboard of the boat; and the provision of such an assembly which, together with the motor secured thereto, is readily removable from the boat and replaceable back on the boat with the motor assuming its aforesaid predetermined position.

Generally, an assembly of this invention for mounting an outboard motor on a boat, such as at the stern thereof, comprises an arm extending aft from the stern and having means at its aft end for mounting the outboard motor at the stern, guide means for guiding the arm fore and aft of the boat, and a base for removably mounting the guide means in a fixed position relative to the boat. The base is adapted to be mounted on the boat within a specified distance inboard of the stern, with the arm being axially adjustable in the guide means for mounting the motor at a predetermined position aft of the stern of the boat when the base is mounted at different distances within said specified distance inboard of the stern. Means are also provided whereby the arm may be secured to the guide means in any of its adjusted positions for mounting the motor at its predetermined position. The guide means and arm secured thereto in its adjusted position, together with the motor secured to the mounting means on the arm, are all removable as a unit from the base and replaceable on the base with the motor assuming its predetermined position.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
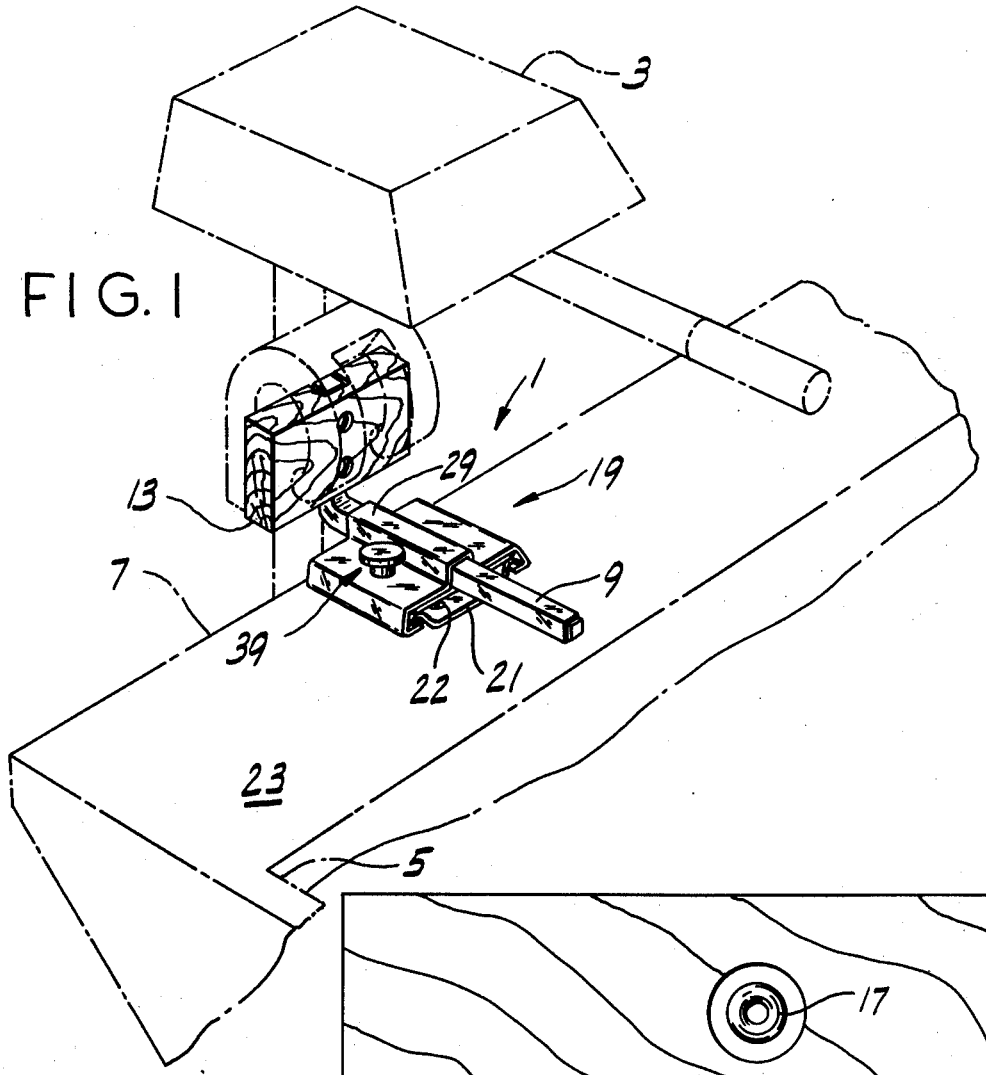
FIG. 1 is a perspective of an assembly of this invention mounting an outboard motor at the stern of a boat.

Referring now to the drawings, a motor mounting assembly of this invention is designated generally by the reference numeral 1 and is shown in FIG. 1 mounting an outboard motor 3 on a boat 5. As shown, the motor is mounted on the stern 7 of the boat, although it will be understood that assembly 1 may also suitably be used for mounting the motor at the bow (not shown) of the boat or at other suitable locations around the boat.

More particularly, assembly 1 comprises a tubular arm 9, generally square in cross section, extending aft from stern 7 and having an aft end portion 11 bent up from the arm for carrying a mounting block 13. This block, which constitutes means for mounting the outboard motor 3 at the stern of the boat, is preferably of treated wood (such as oak or teak) and has a vertical notch 15 therein in which aft end portion 11 of the arm is received. Rivets 17 or other suitable means secure the block to the arm. The motor 3, which may be an electric trolling motor or a small gasoline auxiliary motor, is clamped in a conventional manner to block 13 for mounting the motor at the stern of the boat.

Figure 5:
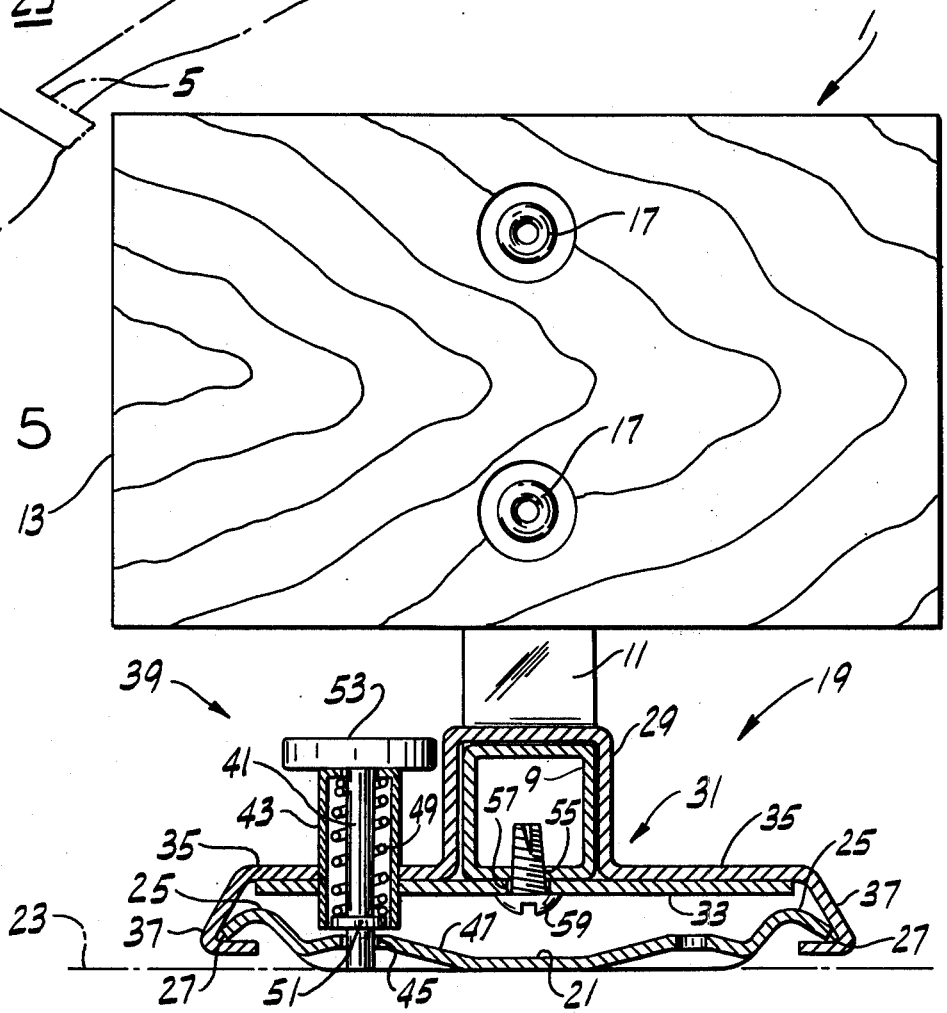
FIG. 5 is an enlarged vertical section taken along line 5—5 of FIG. 2.
Figure 4:
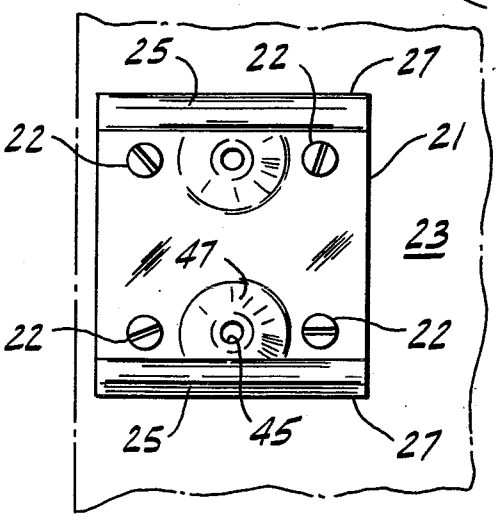
FIG. 4 is a plan of a base secured at the stern of the boat and on which the guide means is adapted to be removably mounted.

The arm 9 is axially slidable in fore-and-aft direction relative to the boat in guide means, indicated generally at 19, removably mounted on a rectangular metal plate or base 21. As shown in FIGS. 4 and 5, plate 21 is mounted by screws 22 or other suitable fasteners on a preferably flat, generally horizontal surface 23 inboard of the stern 7 of the boat. The upwardly offset side margins 25 of plate 21 are rounded and terminate in edges 27 which are aligned generally fore and aft of the boat.

Guide means 19 is interengageable with plate 21 and comprises a tubular guide 29 in which arm 9 is axially slidable. This guide 29 is generally square in section and formed by an upper plate generally designated 31 and a lower plate 33, the upper plate 31 being bent to form the top and side walls of the guide 29 and the lower plate 33 forming the bottom wall of the guide. The upper plate 31 has portions 35 extending generally horizontally outwardly from opposite sides of guide 29 with the outer margins of these portions being bent generally downwardly and inwardly toward each other to form shoulders, each indicated at 37, at opposite sides of the guide means. The upwardly offset side margins 25 of the mounting plate are received in these shoulders 37. Thus, it will be apparent that guide means 19, with arm 9 therein, is readily slidable in fore-and-aft direction relative to the boat.

Indicated generally at 39 is detent means for locking guide means 19 on the mounting plate 21 in a fixed position relative to the boat. As shown best in FIG. 5, this means 39 comprises a pin 41 mounted in a vertical sleeve 43 through upper and lower plates 31, 33 of guide means 19, the pin being movable up and down in the sleeve between a lower locking position (shown in FIG. 5) in which its lower end extends down through a hole 45 in a raised portion 47 of the mounting plate 9 for locking guide means 19 in position on the plate, and an upper retracted position in which the pin is removed from hole 45, allowing the guide means to be slid on and off the plate. A spring 49 around pin 41 and reacting from the top of the sleeve against a flange 51 toward the lower end of the pin biases the pin down toward its locking position. An enlarged annular head 53 at the upper end of the pin is engageable with sleeve 41 to limit downward travel of pin 41 in the sleeve. This head also serves as a knob for pulling the pin up from its locking position to its retracted position.

Figure 2:
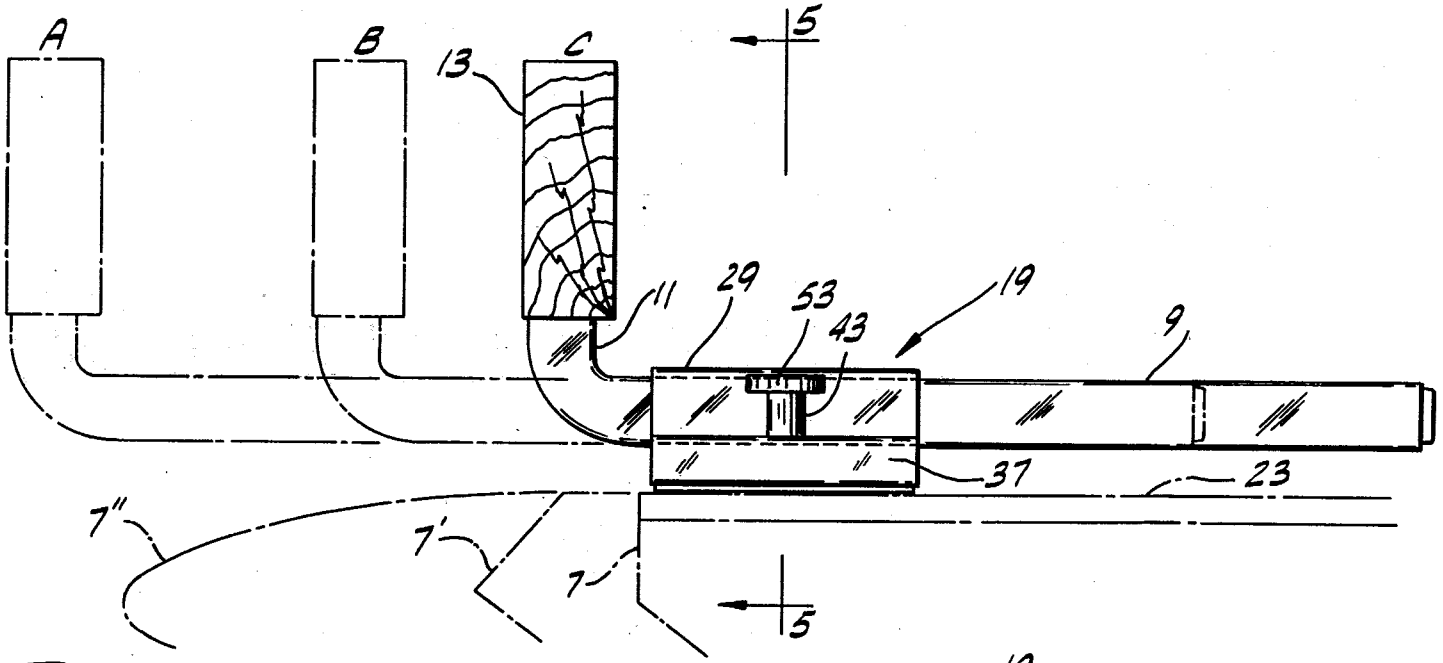
FIG. 2 is a left side elevation of FIG. 1 with the motor removed and showing an arm axially slidable in guide means to different adjusted positions, the stern of the boat being shown in three different configurations to illustrate adjustment of the arm for mounting the motor aft of the boat.

For purposes of illustrating the use of this invention, boat 5 is shown in FIG. 2 as having three different stern configurations 7, 7', and 7''. And arm 13 is shown to be axially slidable in tubular guide 25 to different positions of adjustment relative to the guide for mounting motor 3 at a predetermined position immediately aft of each stern 7, 7', 7'' when mounting plate 9 is fastened to the boat anywhere within a specified distance inboard of the stern. This is advantageous inasmuch as it allows plate 21 to be mounted on the best mounting surface available (such as flat, generally horizontal surface 23) within a specified distance inboard of the stern, i.e., within a distance in which arm 9 is adjustable in guide 19 for positioning mounting board 13 aft of the stern for mounting motor 3 in its predetermined position. In this regard, some types of boats (such as bass and jon boats) have squared-off sterns, thus providing a suitable mounting surface immediately adjacent the aft end of the boat. The stern designated 7 in FIG. 2 is of this latter type. However, other types of boats (runabouts, for example) have sterns (such as shown at 7' and 7'' in FIG. 2) which either slope or curve down toward the aft end of the boat and suitable mounting surfaces are inboard at varying distances therefrom. The adjustability of arm 9 relative to plate 21 allows the latter to be mounted on a flat surface regardless of how far inboard that surface may be so long as it is within the range of adjustment of the arm in guide 25 for mounting motor 3 in its predetermined position aft of the stern.

Figure 3:
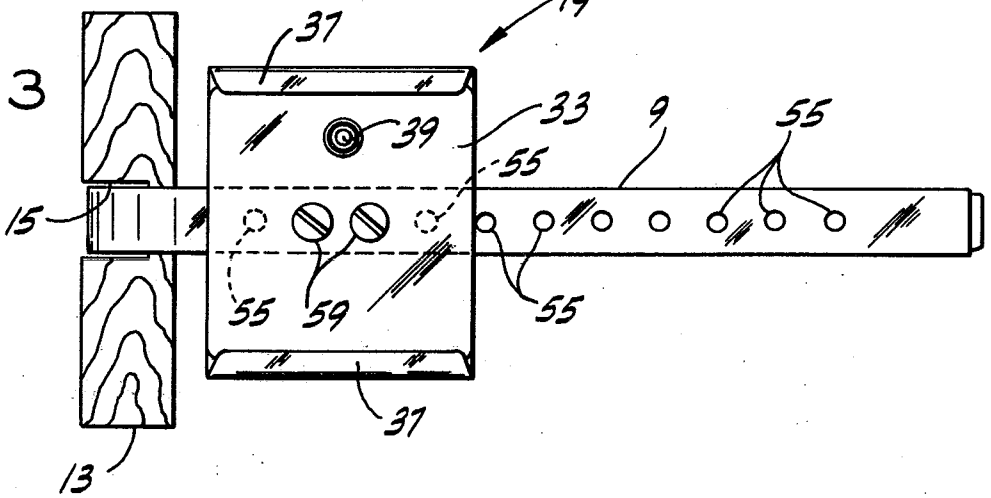
FIG. 3 is a bottom plan of the guide means and arm shown in FIG. 2.

For securing the arm in any of its axially adjusted positions in guide 29, arm 9 has a series of openings, each indicated at 55, spaced at equal intervals (every ¾ inch, for example) along the bottom thereof (see FIG. 3), these openings being movable into register with a pair of holes 57 in the lower plate 33 of guide means 19 on sliding the arm in the tubular guide 29. A pair of self-tapping screws 59, threaded up through holes 57 and into two of the openings 55 in the arm in register with the holes, secure the arm in its adjusted position.

The motor mounting assembly 1 of this invention may be readily mounted on the stern 7 of boat 5 by securing mounting plate 21 (via screws 22) to a flat generally horizontal surface 23 of the boat within a specified distance inboard of the stern, i.e., within a distance in which arm 9 is adjustable for positioning mounting board 13 aft of the stern for mounting motor 3 in its proper position. The guide means 19 is then applied to plate 21 by pulling pin 41 of detent means 39 up to its retracted position and sliding the guide means in fore-and-aft direction onto the mounting plate with the side margins 25 of the plate received in shoulders 37 until the downwardly biased pin 41 springs down into hole 45 in the plate, thus securing the guide means in fixed position relative to the plate and the boat. Arm 9 is then slidably inserted in tubular guide 29 and adjusted axially thereof to position the mounting board 13 for mounting motor 3 immediately aft of the boat in a predetermined position relative to the boat. For example, again referring to FIG. 2, arm 9 is adjusted to position "C" in the case where plate 21 is mounted immediately adjacent stern 7 of the boat, and to positions "B" and "A" where the plate is mounted at various distances inboard of sterns 7' and 7'', respectively.

While keeping arm 9 in its axially adjusted position in guide means 19, the latter is removed from the plate by pulling pin 41 up to its retracted position and sliding the guide means either fore or aft off plate 21. Securement of the arm in its adjusted position is then accomplished by threading the two self-tapping screws 59 through holes 57 in the lower plate and into the two openings 55 in arm 9 which are in register with holes 57. The guide means (and arm therein) is then replaced on plate 21 in the manner described above and the motor mounted on the mounting board 13 in a conventional manner. Thereafter, guide means 19, arm 9 and motor 3 may all be readily removed as a unit from the boat for transport or storage, leaving on the boat only the mounting plate 21 which has a relatively low profile and rounded side margins 25 for reducing the risk of injury. The unit may be quickly and easily replaced on the mounting plate with the motor assuming its proper predetermined position at the stern of the boat.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An assembly for mounting an outboard motor on a boat, such as at the stern thereof, comprising an arm adapted to extend aft from the stern and having means at its aft end for mounting the outboard motor at the stern;

guide means for guiding the arm for axial adjustment of the arm generally in fore-and-aft direction relative to the boat;

a base for removably mounting the guide means in a fixed position relative to the boat, said base being adapted to be mounted on the boat within a specified distance inboard of the stern, with said arm being axially adjustable in the guide means for mounting the motor at a predetermined position aft of the stern of the boat when the base is mounted at different distances within said specified distance inboard of the stern; and means whereby the arm may be secured to the guide means in any one of its adjusted positions for mounting the motor at said predetermined position;

said guide means and arm secured thereto in its adjusted position, and the motor secured to the mounting means on the arm, all being removable as a unit from the base and replaceable on the base with the motor assuming its said predetermined position.

2. A motor-mounting assembly as set forth in claim 1 wherein said guide means is slidably interengageable with the base for being slid on and off the base, said assembly further including detent means for locking the guide means in said fixed position on the base.

3. A motor-mounting assembly as set forth in claim 2 wherein said detent means is on the guide means and is receivable in a hole in the base.

4. A motor-mounting assembly as set forth in claim 2 wherein one of said guide means and said base has a pair of parallel shoulders and the other is adapted to be slidably received in the shoulders on sliding the guide means onto the base.

5. A motor-mounting assembly as set forth in claim 4 wherein the shoulders are on the guide means and said base comprises a mounting plate having upwardly offset side margins adapted to be received in the shoulders when the guide means is slid onto the plate.

6. A motor-mounting assembly as set forth in claim 5 wherein the side edges of said mounting plate are aligned generally fore and aft of the boat for sliding of the guide means on and off the mounting plate in fore-and-aft direction.

7. A motor-mounting assembly as set forth in claim 5 wherein said guide means comprises a tubular guide extending in fore-and-aft direction when mounted on the base for slidably receiving said arm therein, and plate means extending generally horizontally outwardly from opposite sides of the guide with the outer margins of said plate means on opposite sides of the guide being bent downwardly and then inwardly toward each other forming said shoulders.

8. A motor-mounting assembly as set forth in claim 7 wherein said detent means comprises a pin mounted on said plate means for axial sliding movement in a direction generally perpendicular to the plate means between a locking position, in which the pin extends through the plate means and is adapted to enter a hole in the mounting plate for locking the guide means in said fixed position, and a retracted position allowing the guide means to be slid on and off the base.

9. A motor-mounting assembly as set forth in claim 1 wherein said guide means comprises a tubular guide extending in fore-and-aft direction when mounted on said base.

10. A motor-mounting assembly as set forth in claim 9 wherein said tubular guide is generally square in cross section and said arm is generally square in cross section and slidable in the guide.

11. A motor-mounting assembly as set forth in claim 1 wherein said guide means has at least one hole therein and said arm has a series of openings along the length thereof each of which is movable into register with said hole on moving the arm in the guide means to said axially adjusted positions, said means for securing the arm in any one of said adjusted positions comprising a detent adapted to extend through the hole in the guide means and into the opening in the arm in register with the hole when the arm is in its adjusted position.

12. A motor-mounting assembly as set forth in claim 11 wherein said detent comprises a self-tapping screw.

13. A motor-mounting assembly as set forth in claim 1 wherein the aft end portion of said arm extends upwardly from the arm and has said mounting means secured thereto.

14. A motor-mounting assembly as set forth in claim 13 wherein said mounting means comprises a mounting block having a notch in one face thereof, said aft end portion of the arm being received in the notch and secured to the block.

* * * * *